US007322496B2

(12) United States Patent
Yotabunn et al.

(10) Patent No.: US 7,322,496 B2
(45) Date of Patent: Jan. 29, 2008

(54) BRICK BODY FOR ROTARY NOZZLE

(75) Inventors: Tomohiro Yotabunn, Tokyo (JP); Tsuyoshi Mizuno, Tokyo (JP); Hideto Takasugi, Kanagawa (JP); Tsuneo Kondo, Tokyo (JP); Hisao Inubushi, Tokyo (JP)

(73) Assignees: JFE Refractories Corporation, Ako (JP); Nippon Rotary Nozzle Co., Ltd., Yokohama-Shi (JP); Tokyo Yogyo Kabushiki Kaisha, Tokyo (JP); JFE Mechanical Co., Ltd., Tokyo (JP)

( * ) Notice: Subject to any disclaimer, the term of this patent is extended or adjusted under 35 U.S.C. 154(b) by 0 days.

(21) Appl. No.: 10/550,862

(22) PCT Filed: Jun. 25, 2004

(86) PCT No.: PCT/JP2004/009366

§ 371 (c)(1),
(2), (4) Date: Aug. 14, 2006

(87) PCT Pub. No.: WO2005/000501

PCT Pub. Date: Jan. 6, 2005

(65) Prior Publication Data

US 2006/0273499 A1 Dec. 7, 2006

(30) Foreign Application Priority Data

Jun. 27, 2003 (JP) ..... 2003-184600

(51) Int. Cl.
*C21C 5/44* (2006.01)

(52) U.S. Cl. ..... 222/600; 222/597

(58) Field of Classification Search ..... 222/598, 222/597, 600

See application file for complete search history.

(56) References Cited

U.S. PATENT DOCUMENTS 4,618,126 A 10/1986 Tinnes et al.

(Continued)

FOREIGN PATENT DOCUMENTS

EP 0 838 291 4/1998

(Continued)

OTHER PUBLICATIONS

Patent Abstract of Japan Publication No. 06-015440 Published Jan. 25, 1994.
Patent Abstracts of Japan 09225627 dated Sep. 2, 1997.
Patent Abstracts of Japan 06015440 dated Jan. 25, 1994.

*Primary Examiner*—Scott Kastler
(74) *Attorney, Agent, or Firm*—Ladas & Parry LLP

(57) ABSTRACT

In a rotary nozzle brick body formed into a substantially egg-like shape in it's plan view, the present invention secures a contact area of a nozzle portion and improves a configuration factor which considerably affecting the durability of the body. A rotary nozzle brick body is characterized in that the external shape in plan view is comprised of first circular portions (G), second circular portions (H), third circular portions (K), and tangent lines connecting the first circular portions and third circular portions so that a substantially elliptical shape is formed by increasing the circular portion and shortening the tangent lines, instead of a substantially egg-like shape having long tangent lines. Since the substantially elliptical shape is formed by reducing the linear portion of the brick body in it's plan view while the shape is expanded circularly, the contact area is maintained even if the sliding plate brick is rotated up to it's full-opened state, thereby eliminating a fear that molten steel or the like may leak.

3 Claims, 10 Drawing Sheets

U.S. PATENT DOCUMENTS

| | | | | |
|---|---|---|---|---|
| 4,747,580 | A | | 5/1988 | Tinnes et al. |
| D371,825 | S | * | 7/1996 | Yoshihara ..... D23/237 |
| 5,709,807 | A | * | 1/1998 | Yoshihara ..... 222/600 |
| 6,026,996 | A | | 2/2000 | Hayakawa et al. |

FOREIGN PATENT DOCUMENTS

| | | | |
|---|---|---|---|
| JP | 61 009 964 | | 1/1986 |
| JP | 61-9964 | A | 1/1986 |
| JP | 06 015 440 | | 1/1994 |
| JP | 6-15440 | A | 1/1994 |
| JP | 09 225 627 | | 9/1997 |
| JP | 03 278 797 | | 4/2002 |
| JP | 3278797 | B2 | 4/2002 |
| WO | 01/41956 | | 6/2001 |
| WO | 02/070173 | | 9/2002 |

* cited by examiner

PRIOR ART

PRIOR ART

PRIOR ART

PRIOR ART

BRICK BODY FOR ROTARY NOZZLE

TECHNICAL FIELD

The present invention relates to a brick body for a rotary nozzle which is mounted on the bottom of molten steel container such as a ladle and a tundish so as to control the pouring amount of molten steel or the like by adjusting the opening degree of nozzle holes between a sliding plate brick and a fixed plate brick with aid of rotating the sliding plate brick.

BACKGROUND ART

The rotary nozzle has been widely used as a device for adjusting the quantity of molten steel, in an appliance such as a ladle for carrying molten steel discharged from a steel converter or pouring into a mold, or a tundish for receiving molten steel from the ladle and pouring into a mold. In a rotary nozzle 25 conventionally used, as shown in FIGS. 3, 4, a fixed plate brick 2*a* is fixed in a concave portion 17 of an upper case 15 mounted on a base plate 10 installed on the bottom 9 of a ladle 8. A sliding plate brick 3*a* is fixed in a concave portion 18 of a lower case 16 capable of rotating.

A nozzle hole 4*a* is made in the fixed plate brick 2*a* and,the fixed plate brick 2*a* is fixed to the upper case 15 at a position in which the hole 4*a* matches with a nozzle hole 13 in the upper nozzle 11. Nozzle holes 5*b*, 5*c* are made in the sliding plate brick 3*a* and the sliding plate brick 3*a* is fixed to the lower case 16 at a position in which the holes 5*b*, 5*c* match with nozzle holes 14, 14*a* in the lower nozzles 12, 12*a*. As shown in FIG. 3, a gear 19 is provided on the outer peripheral portion of the head portion of the lower case 16 which fixes the sliding plate brick 3*a* and this gear 19 is meshed with a gear 21 of a reducer 20 installed on the bottom 9 of the ladle 8, so that the sliding plate brick 3*a* is rotated by a drive motor 22 used as a drive power, sliding on a fixed plate brick face 2*a* while maintaining a contact force to the fixed plate brick 2*a*.

Thus, molten steel flows from the nozzle hole 13 in the upper nozzle 11 into the nozzle hole 4*a* in the fixed plate brick 2*a* as indicated with an arrow in FIG. 4. The sliding plate brick 3*a* rotates up to a position in which either of the nozzle hole 5*b* and the nozzle hole 5*c* in the sliding plate brick 3*a* and thus either of the nozzle holes 14 and 14*a* in the lower nozzles 12, 12*a* matches with the nozzle hole 4*a* in the fixed plate brick 2*a*, and the molten steel flows further and is poured.

As for control of the pouring amount of molten steel, as shown in FIGS. 5*a*, 5*b*, as the rotation starts, the nozzle hole 5*b* in the sliding plate brick 3*a* and the nozzle hole 14 in the lower nozzle 12 deviate from the nozzle hole 13 in the upper nozzle 11 and the nozzle hole 4*a* in the fixed plate brick 2*a* so that an opening portion 23 narrows gradually. As the sliding plate brick 3*a* rotates further, the nozzle hole 4*a* in the fixed plate brick 2*a* is closed as shown in FIGS. 6*a*, 6*b* and the nozzle hole 4*a* remains closed completely until the sliding plate brick 3*a* rotates further so that the nozzle hole 5*b* in the sliding plate brick 3*a* meets with the nozzle hole 4*a* in the fixed plate brick 2*a*. As a result, discharge of molten steel from the ladle is stopped temporarily. In this way, the rotary nozzle repeats its sliding rotation to adjust the discharge amount of molten steel.

Since the fixed plate brick and the sliding plate brick of a conventional rotary nozzle are damaged due to melting by a passage of high temperature molten steel during this sliding rotation, there is a fear that molten steel may leak. Therefore, both the bricks have been handled as consumable parts which must be replaced periodically. However, because the fixed plate brick and the sliding plate brick are expensive, it has been indispensable to study about the configuration and structure which enables its durability to be improved to extend the replacement cycle as long as possible. Thus, as a related art , an invention of Japanese Patent Application No. 327897 (rotary nozzle brick body and rotary nozzle) (hereinafter referred to as the conventional invention) was made and has been well known.

The above-described conventional invention intends to reduce cost by forming the brick body composed of the fixed plate brick and sliding plate brick into a reasonable and economical shape. Reduction of cost is actually achieved by forming into a substantially egg-like shape in its planview. However, the substantially egg-like shape reduces the contact area when the sliding plate brick is in a half opened state or in a transition from the half-opened state to a full-opened state during rotation, so that the contact distance between the fixed plate brick and the sliding plate brick decreases. As a consequence,a probability of molten steel leakage outside through that location has been recognized as a critical issue in practice Accordingly an object of the present invention is to obtain a fixed plate brick and sliding plate brick having a reasonable shape by forming into a shape free of problems about leakage and durability in order to eliminate leakage for safety and improve cost matter relating to the durability.

DISCLOSURE OF THE INVENTION

The present invention has been achieved to solve the above-described problem and the gist of the present invention is a rotary nozzle brick body having a single nozzle hole or two nozzle holes, comprising: assuming that A is a safety margin at the time of a 90° full-closed state of the nozzle hole in the brick body, B is a safety margin at the time of a full-opened state of the nozzle hole in the brick body, C is a distance between the center X of the brick body and the center Y of the nozzle hole, D is the diameter of the nozzle hole in the brick body and $C>4D/\pi$, first circular portions having a radius of $C+(D/2)+A$ formed on both sides of a center X of the brick body; second circular portions having a radius of $C+(D/2)+B$ around the center Y of a nozzle hole located on a substantial center line between the two first circular portions and being formed perpendicularly to the direction of the first circular portions in a range of $\theta=40\pm10°$ in terms of the central angle of the brick; and third circular portions having a radius of $(D/2)+B$ and being formed around intersections Z between a circular line drawn with a radius C around the center X of the brick body and lines drawn from the center X to both end points of the second circular portions, wherein the second circular portions and the third circular portions are connected smoothly, the first circular portions and the third circular portions are connected with tangent lines in terms of the plan view contour, and the plan view contour is substantially symmetrical with respect to the center X, where $B>A$.

In the brick body, it is preferable that A is set to 30±15 mm and B is set to 60±15 mm.

BRIEF DESCRIPTION OF THE DRAWINGS.

FIG. 6*a* is a reference front view for explaining a full-closed state of the brick body of the conventional invention and.

BEST MODE FOR CARRYING OUT THE INVENTION

Figure 1A:
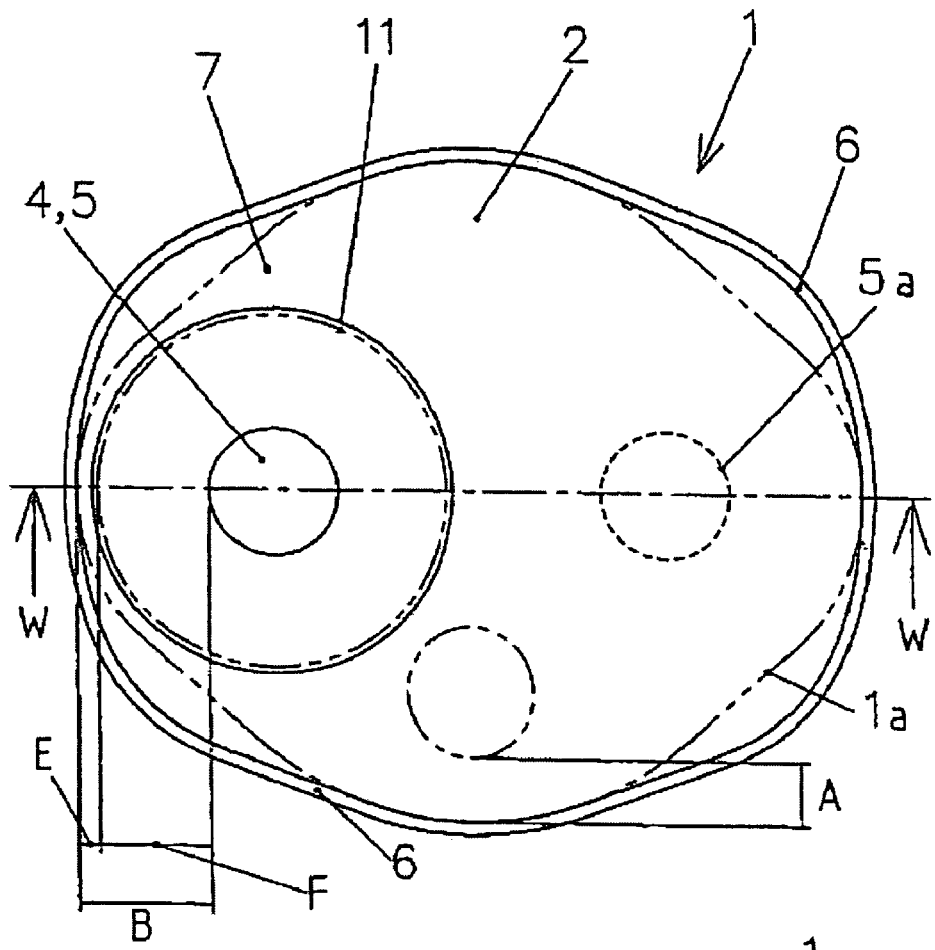
FIG. 1*a* is a plan view of a rotary nozzle brick body of the present invention and FIG. 1*b* is a sectional view taken along W-W of the rotary nozzle brick body of the present invention.
Figure 1B:
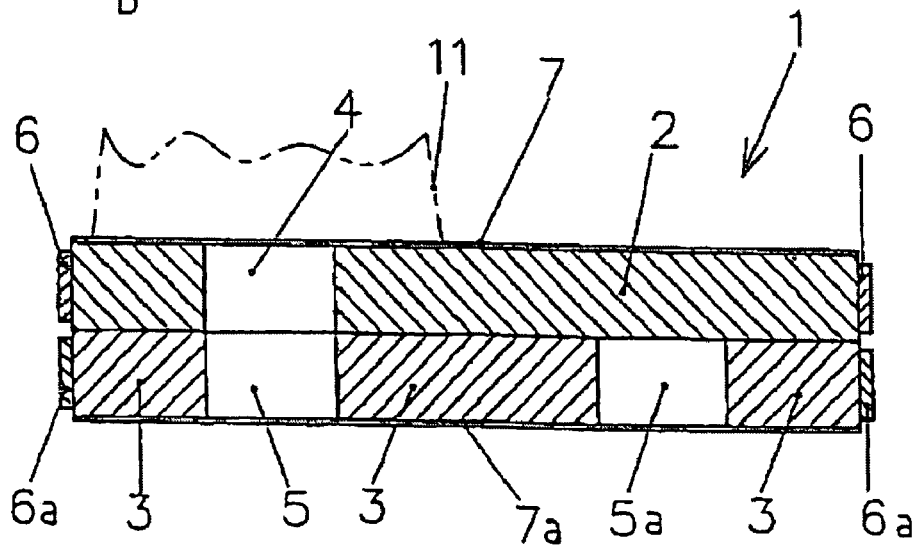

The present invention will be described in detail with reference to drawings of the embodiments. FIG. 1*a* is a plan view of a brick body 1 of the rotary nozzle of the present invention. A fixed plate brick 2 and a sliding plate brick 3 is totally called the brick body 1 as shown in FIG. 1*b*. Reference numeral 2 denotes a fixed plate brick whose plan view shape is substantially elliptical. In FIG. 1*b*, reference numeral 3 denotes a sliding plate brick having the same shape as the fixed plate brick 2. The fixed plate brick 2 and the sliding plate brick 3 have the same shape although they are different in structure because the fixed plate brick 2 has one nozzle hole while the sliding plate brick 3 has two nozzle holes. Thus, the sliding plate brick 3 will be mainly described in a following description. When necessary, the fixed plate brick 2 will be referred. In the meantime, a shape indicated with two dot and dash line indicates a conventional brick body 1*a* having substantial egg-like shape.

Figure 2:
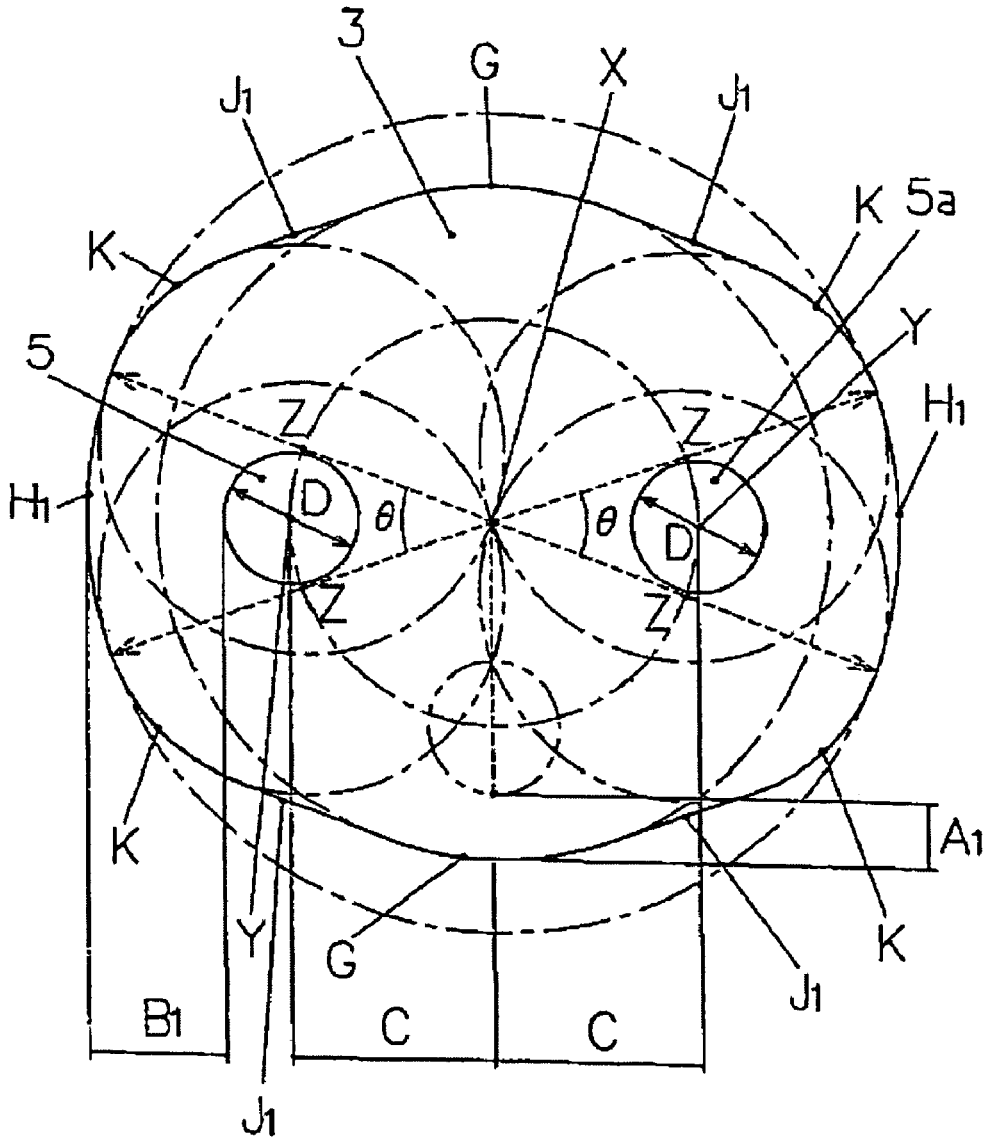
FIG. 2 is a detailed explanatory diagram showing trajectory lines of the sliding plate brick as seen in plan view in the rotary nozzle brick body of the present invention.
Figure 3:
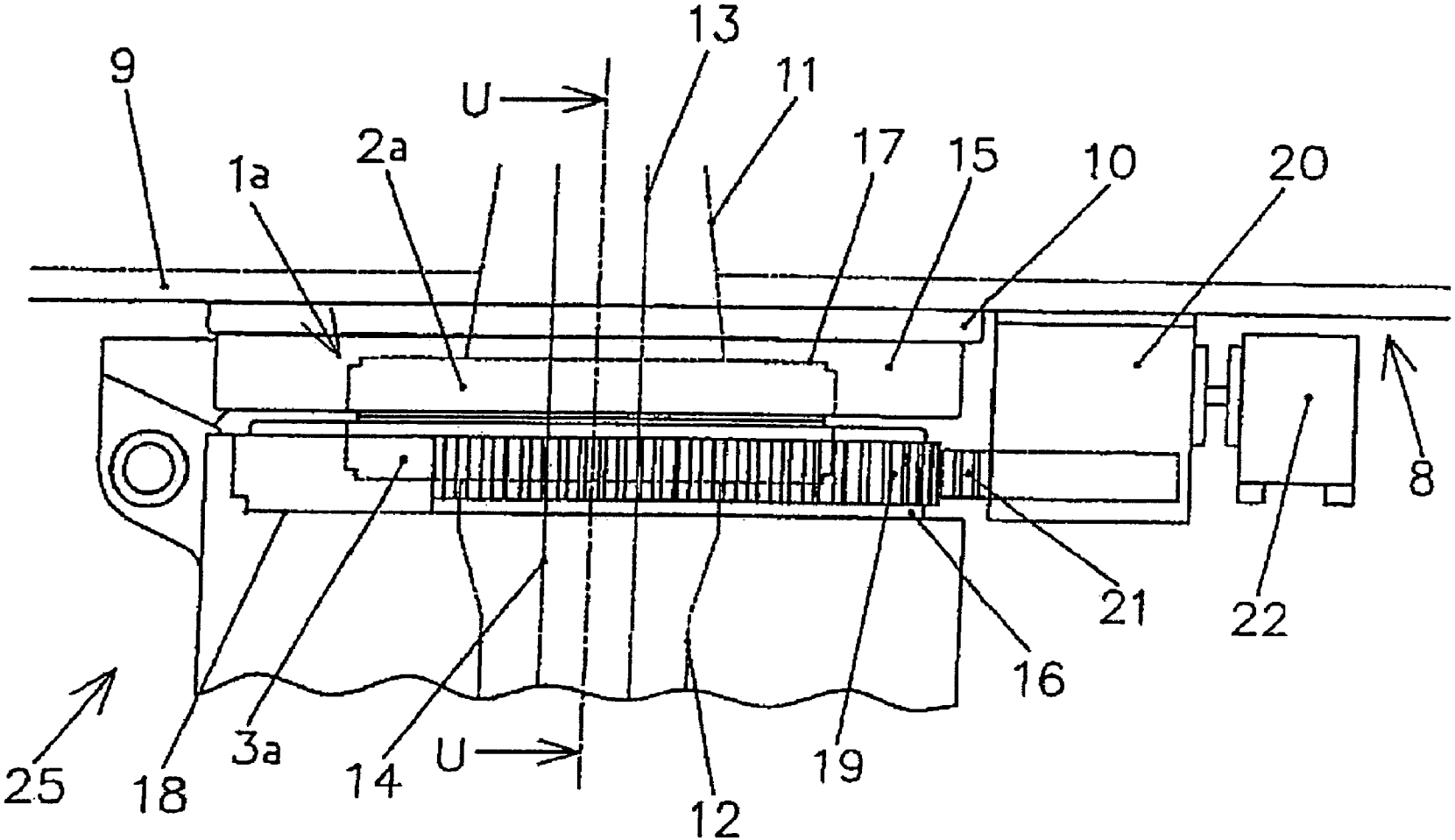
PRIOR ART FIG. 3
FIG. 3 is a reference front view of major portions of the rotary nozzle of a conventional invention.
Figure 4:
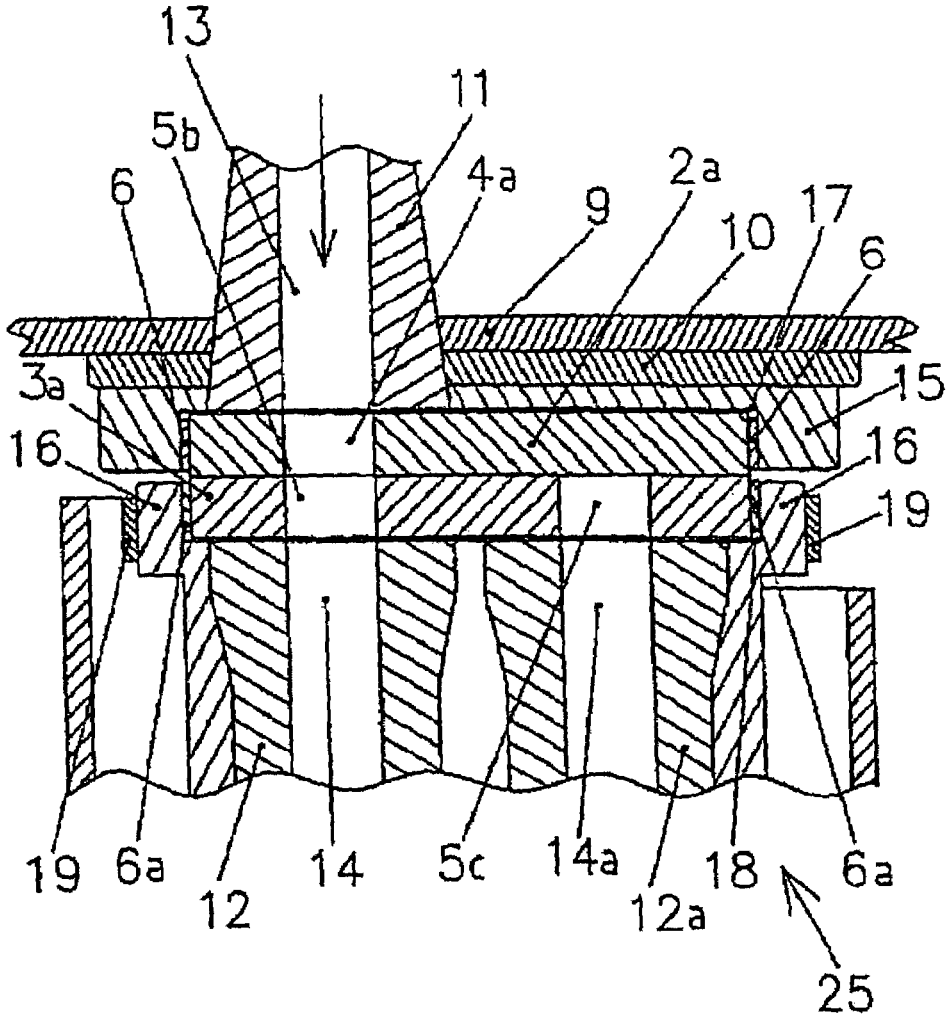
FIG. 4 is a reference sectional view taken along U-U in FIG. 3 of the rotary nozzle of the conventional invention.
Figure 5A:
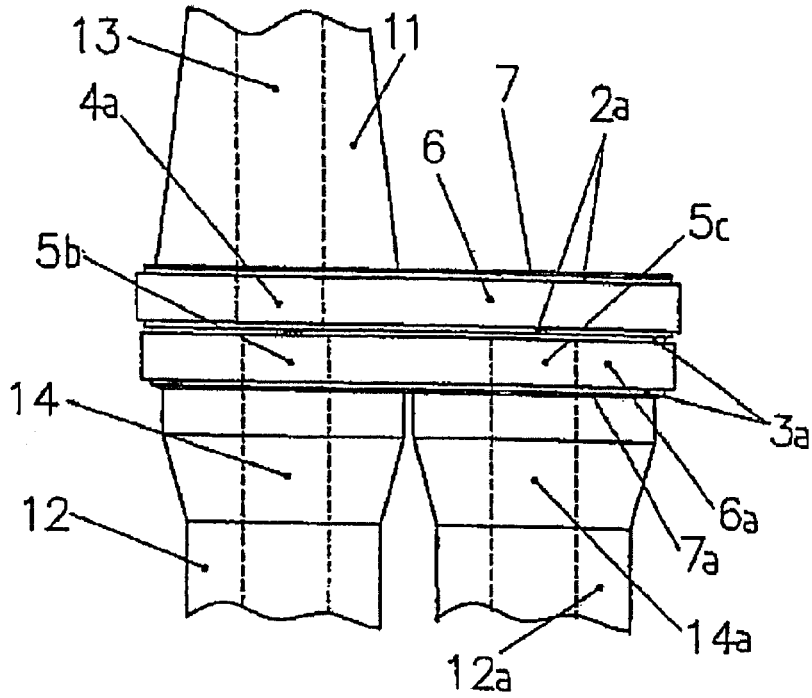
FIG. 5a PRIOR ART
FIG. 5*a* is a reference front view for explaining a half-opened state of the brick body of the conventional invention and FIG. 5*b* is a reference plan view for explaining the half-opened state of the brick body of the conventional invention.
Figure 5B:
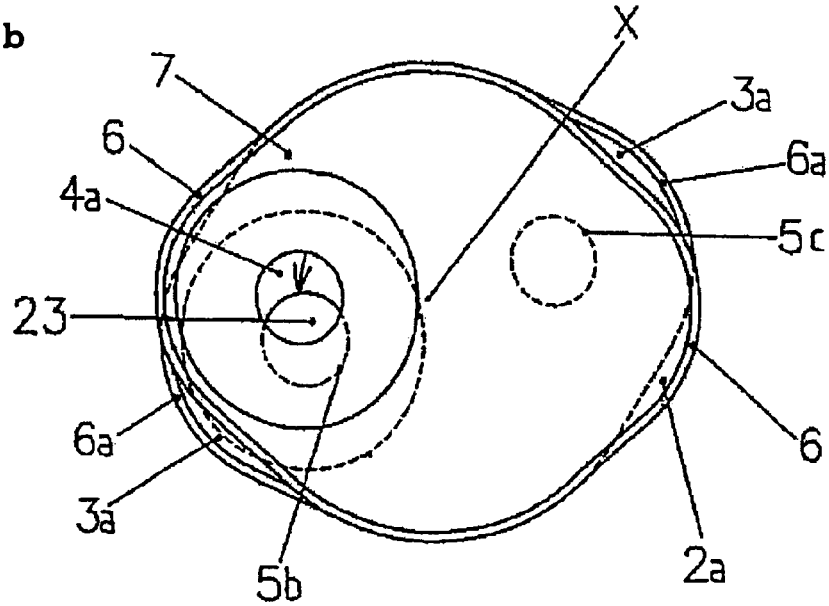
Figure 6A:
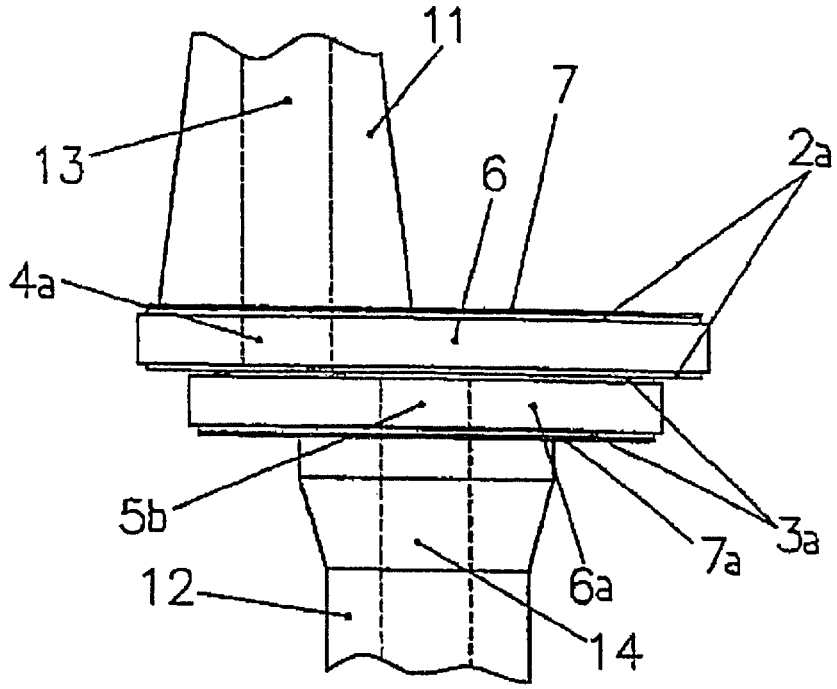
PRIOR ART FIG. 6a
Figure 6B:
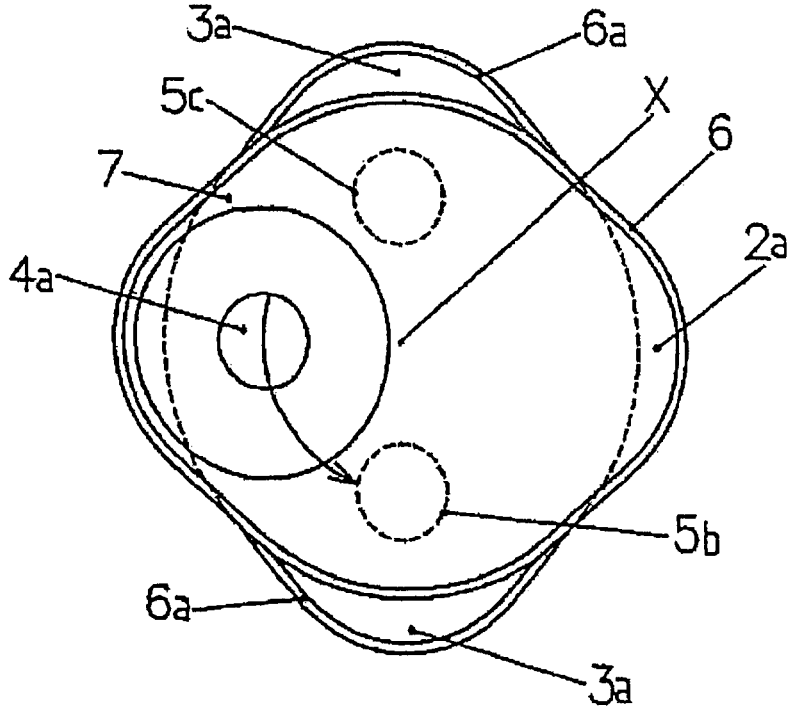
FIG. 6*b* is a reference plan view for explaining the full-closed state of the brick body of the conventional invention.

FIG. 2 shows a locus diagram for forming the outline of a plan view shape of the sliding plate brick 3. A1 designates a safety margin at the time of 90° full-closed state, B1 designates a safety margin at the time of full-opened state, C designates a distance between the center X of the sliding plate brick 3 and the center Y of the nozzle holes 5, 5*a* and D designate the diameter of the nozzle holes 5, 5*a*.

First circular portions G in plan view of the sliding plate brick 3 are formed with a radius C+(D/2)+A1 around the center X and second circular portions H1 are formed with a radius C+(D/2)+B1 in a range of a central angel θ. Further, third circular portions K are formed with a radius (D/2)+B around Z which are intersections between a circle drawn with a radius C around the center X and lines extended at an angle 0 from the center X. A shape of the sliding plate brick 3 in plan view is formed by connecting the first circular portions G with the third circular portions K with a tangent line J1. Where B1>A1, and particularly it is preferable that A1=30±15 mm, B1=60±15 mm. θ is set to 40±10°.

Referring to FIGS. 1*a*, 1*b*, two nozzle holes 5, 5*a* are made in the sliding plate brick 3. The nozzle holes 5, 5*a* are of the same diameter because they are matched with the upper nozzle 11 and the lower nozzles 12, 12*a*. As shown in FIG. 2, the diameter D of the nozzle holes 5, 5*a* is empirically determined depending on operating condition such as the height of molten steel in the ladle, casting speed and the like. If the distance C from the center X is too small, the nozzle holes 5, 5*a* may join due to melting of the nozzle holes 5, 5*a* thereby possibly causing leakage. Thus, empirically, the distance needs to be so large that two nozzle holes each having a diameter D can be incorporated in a four divided line of a circle drawn with a radius C around the center X. Therefore, it comes that C>4D/π. Although the two nozzle holes are made in the sliding plate brick 3, a single nozzle hole may be permitted depending on an operating condition and the present invention is not restricted to two nozzle holes.

Sheets 7, 7*a* made of fire resistant paper or aluminumare adhered to the rear faces of the fixed plate brick 2 and the sliding plate brick 3 in order to block leakage while securing a smooth operation and intensifying adhesive property as shown in FIG. 1*b*. Then, iron bands 6, 6*a* are fixed around the outer peripheral faces of the fixed plate brick 2 and the sliding plate brick 3 to prevent deformation and cracks due to high temperatures.

Figure 7:
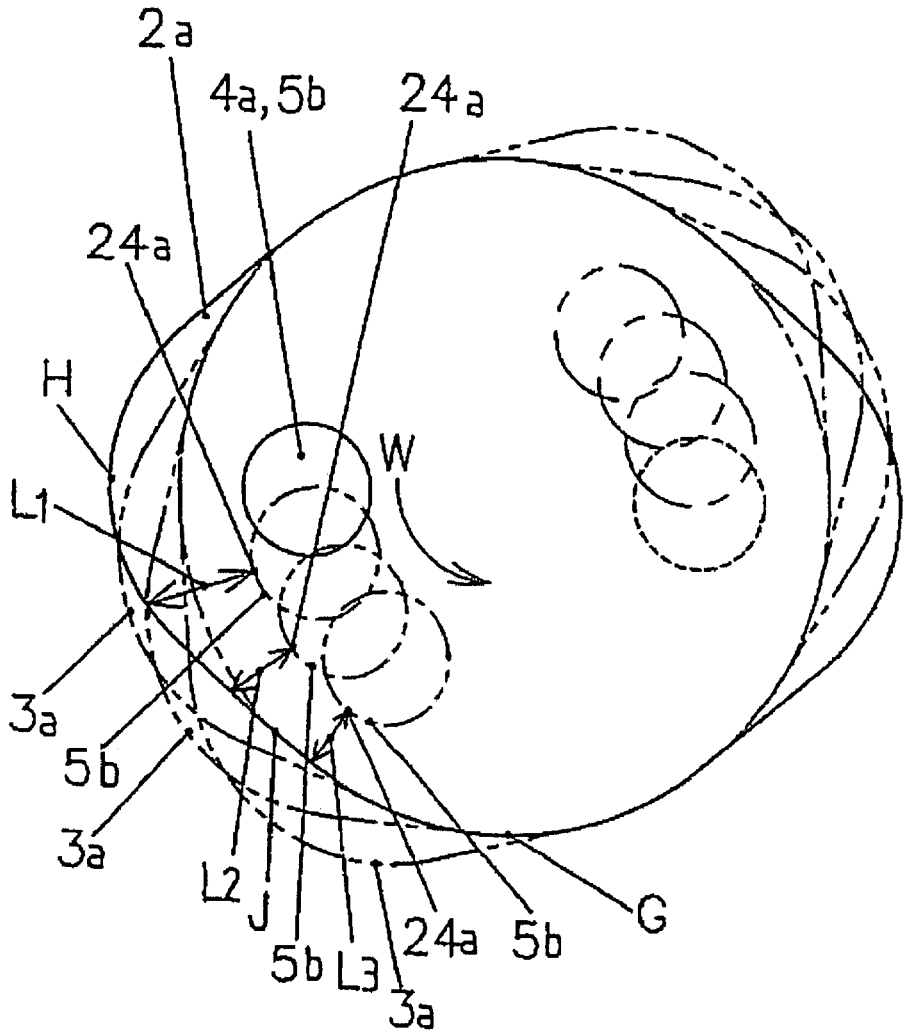
FIG. 7 is a detailed explanatory diagram showing the trajectory of the brick body of the conventional invention from its half-opened state to full-closed state.

A difference in structure between the conventional invention and the present invention will be described with reference to FIGS. 7, 8, 9, and 10. As shown in FIG. 1, as for the safety margins A, B of the rotary nozzle of the conventional invention, empirically, A is set to 5 mm to 1D mm (where D is the diameter of the nozzle holes 4, 5, 5*a* in the above-described fixed plate brick 2 and the sliding plate brick 3) and B is set to E+F (where E is 0 mm to 15 mm). However, as shown in FIG. 7, when the sliding plate brick 3*a* of the conventional invention is rotated in a rotation direction W, distances L1, L2, L3 from an circular edge portion 24*a* of the nozzle hole 5*b* to an outer side face of the fixed plate brick 2*a* at the time of a half-opened state and transitional states between the half-opened state and a full-closed state indicate that the nozzle hole 4 in the sliding plate brick 3*a* approaches a tangent line J to a first circular portion G and a second circular portion H of the fixed plate brick 2*a*. Thus, the contact area between the fixed plate brick 2*a* and the sliding plate brick 3*a* narrows and consequently, the contact distance shortens at L1, L2, L3 in a range where the circular edge portion 24*a* of the nozzle hole 5*a* approaches the outer side face of the fixed plate brick 2*a* during rotation of the sliding plate brick 3*a*. Thereby, there is a great fear of leakage of molten steel.

Figure 8:
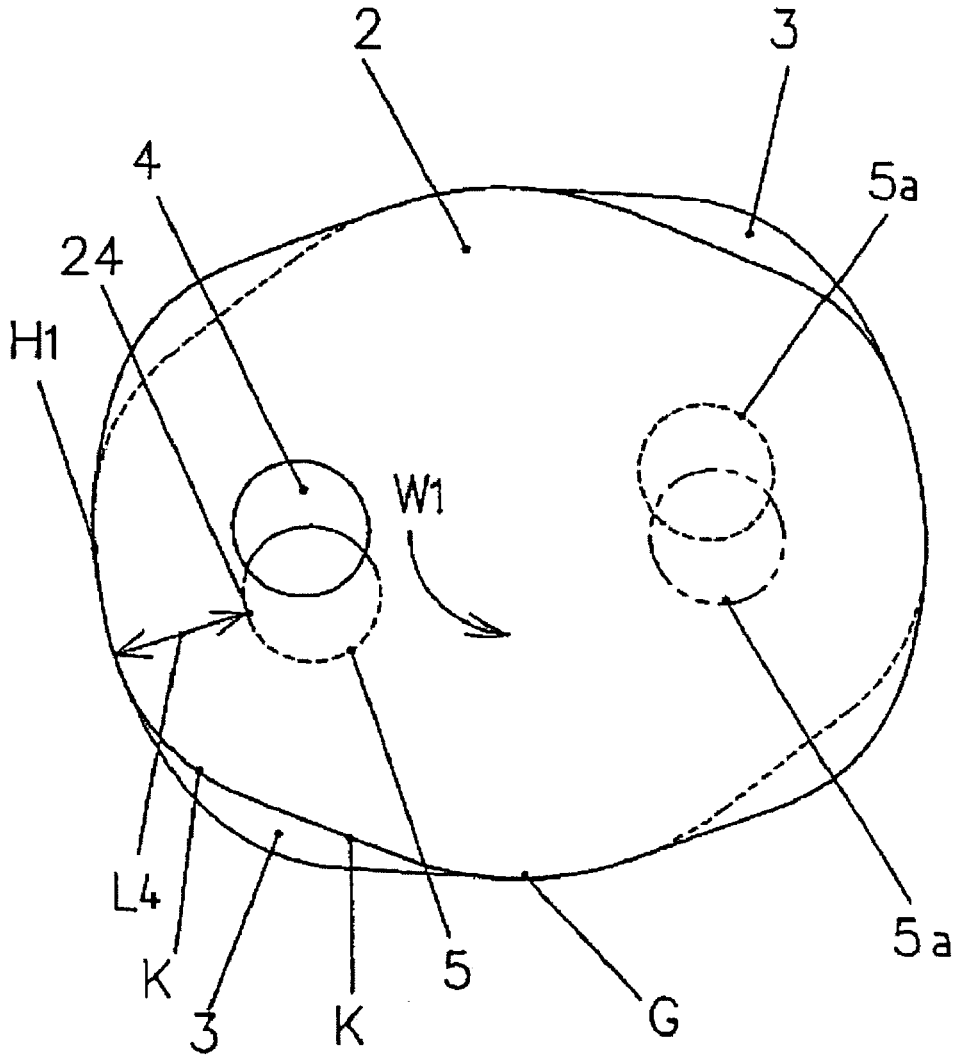
FIG. 8 is an explanatory diagram showing the trajectory of the brick body of the present invention up to the half-opened state.
Figure 9:
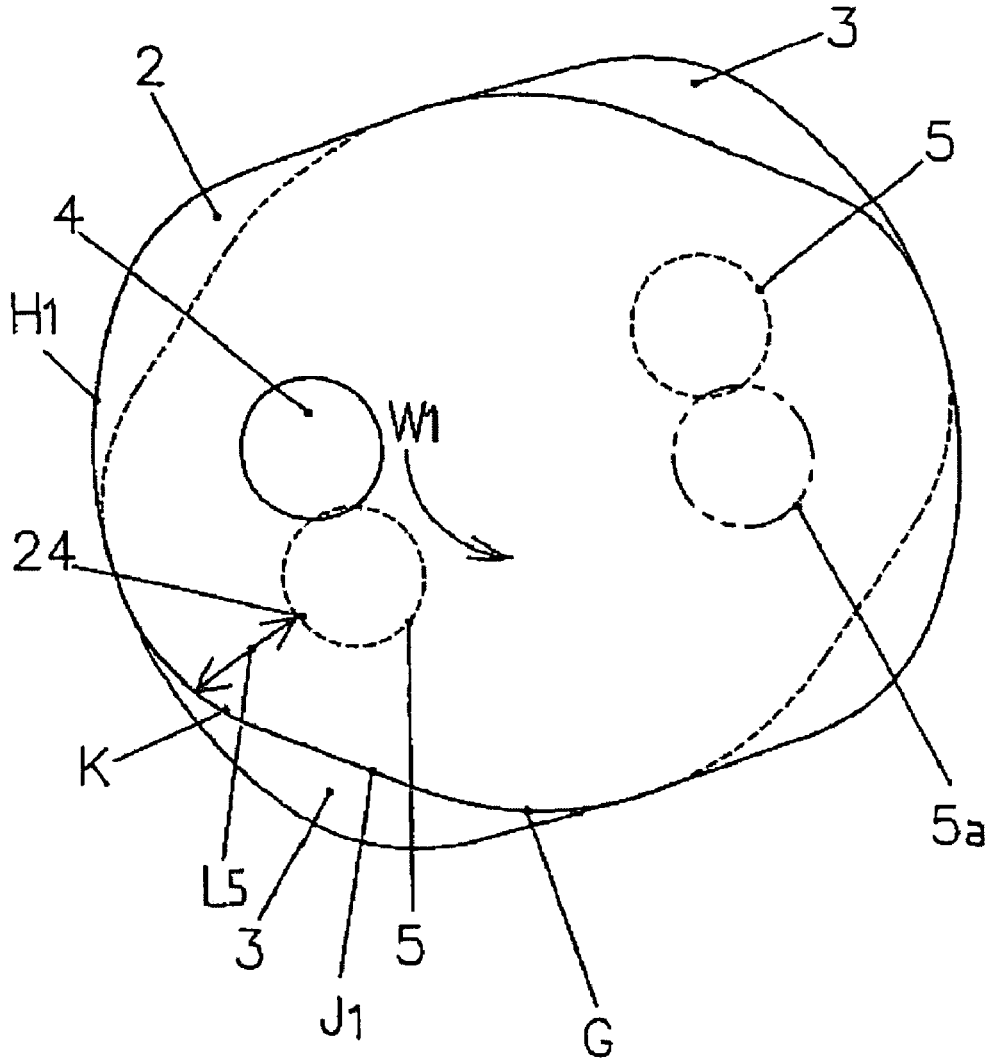
FIG. 9 is an explanatory diagram showing the trajectory of the brick body of the present invention from the half-opened state to the full-closed state.
Figure 10:
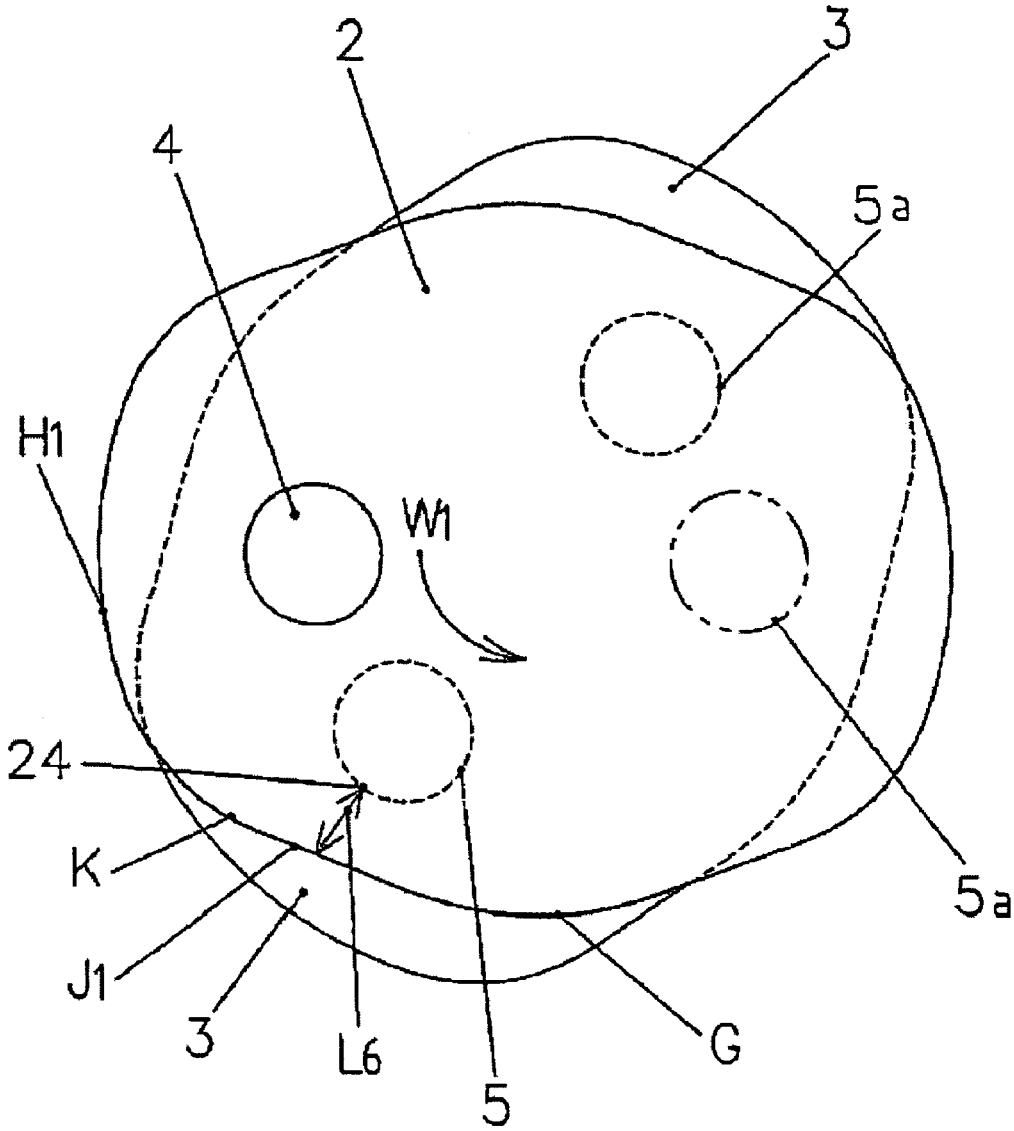
FIG. 10 is an explanatory diagram showing the trajectory of the brick body of the present invention up to the full-closed state.

Thus, according to the present invention, as shown in FIG. 8, when the sliding plate brick 3 of the present invention is rotated in the rotation direction W1 up to a half-opened state, a considerably larger contact area than the conventional brick body as shown in FIG. 7 is maintained even though the circular edge portion 24 of the nozzle hole 5 in the sliding plate brick 3 approaches the second circular portion H1 and the third circular portion K of the fixed plate brick 2. Therefore, the contact area is not decreased largely and a distance L4 is maintained. An improvement is clearly recognized if comparing with a distance L1 at the same rotation in FIG. 7. When the sliding plate brick 3 is full-closed from its half-opened state as shown in FIG. 9, a considerably larger contact area than the conventional brick body as shown in FIG. 7 is maintained even though the circular edge portion 24 of the nozzle hole 5 in the sliding plate brick 3 approaches the second circular portion H1 and the third circular portion K of the fixed plate brick 2. Therefore, the contact area is not decreased largely and a distance L5 is maintained. An improvement is clearly recognized if comparing with the distance L2 at the same rotation in FIG. 7. When the sliding plate brick 3 is full-closed as shown in FIG. 10, even though the circular edge portion 24 of the nozzle hole 5 in the sliding plate brick 3 approaches the second circular portion H1 and the third circular portion K of the fixed plate brick 2 with a distance L6 between them. However, the distance is improved as compared with the distance L3 at the same rotation in FIG. 7 although the contact area is reduced. Thus, because the contact area between the fixed plate brick 2 and the sliding plate brick 3 is considerably larger in comparison with the conventional brick body, the state to maintain a preferable contact distance is improved.

Thus, according to the present invention, during rotation of the sliding plate brick 3 up to a full-closed state, a preferable contact area between the fixed plate brick 2 and the sliding plate brick 3 is secured and a preferable contact distance is maintained. By empirically setting the safety margin A1 to 30±15 mm and the safety margin B1 to 60±15 mm, a fear that molten steel may leak outside due to the short contact distance in the contact area is reduced so that the durability is increased.

The brick body of the present invention is formed into a substantially elliptical form in which a number of circular portions and tangent lines are increased in its plan view shape instead of a substantially egg-like shape and the safety margin Al and the safety margin B1 are set to 30±15 mm and 60±15 mm respectively. Consequently, a preferable contact area is secured during rotation so that a contact distance between the fixed plate brick and the sliding plate brick is maintained in a preferable condition. Thus, it is possible to provide an excellent rotary nozzle brick body with which molten steel can be securely poured with safety, without leaking outside.

According to the present invention, by forming the brick body into a reasonable, economic and durable substantially elliptical shape, a maximum effect can be exerted with a minimum necessary area and the frequency of replacement of the brick body composed of expensive material can be reduced, thereby saving cost. At the same time, the present invention largely contributes to improvement in problems such as resource saving, environment and energy resources.

The invention claimed is:

1. A rotary nozzle brick body, comprising:

first circular portions having a radius of C+(D/2)+A formed on both sides of a center X of the brick body;

second circular portions having a radius of C+(D/2)+B formed around the center X of the brick body perpendicularly to the direction of the first circular portions, in a range of Θ=40 ±10° in terms of the central angle of the brick; and third circular portions having a radius of (D/2)+B and being formed around an intersections Z obtained by connecting a circular line drawn with a radius C around the center X to both end points of the second circular portions, where, when a fixed brick body with single nozzle hole and the slide brick body with at least a single nozzle hole having the same form with the fixed brick body and face contacting the same to slide-rotate are collectively referred to as the rotary nozzle brick body, A is a safety margin at the time of a 90° full-closed state of the nozzle hole in a slide brick body, B is a safety margin at the time of a full-opened state of the nozzle hole in the brick body, C is a distance between the center X of the brick body and the center Y of the nozzle hole, D is the diameter of the nozzle hole in the brick body, and $C>4D/\pi$ and B>A, wherein a planar shape is made a substantially elliptical shape by connecting the first circular portions and the third circular portions with tangent lines.

2. The rotary nozzle brick body according to claim 1, wherein A is set to 30±15 mm and B is set to 60±15 mm.

3. A brick body for a rotary nozzle of a fixed one of the brick body and a sliding one of the brick body, where the fixed one of the brick body has a single nozzle hole and the sliding one of the brick body has at least a single nozzle hole, the fixed and sliding ones of the brick body having the same form and face contacting each other to slide-rotate relative to each other, A being a safety margin at a 90° full-closed state of the nozzle holes, B being a safety margin at a full-opened state of the nozzle holes, C being a distance between a center X of each of the fixed one and the sliding one of the brick body and a center Y of the nozzle hole thereof, and D being a diameter of the nozzle holes, where $C>4D/\pi$ and B>A, sides of the brick body comprising:

first circular portions respectively on opposite sides of a center X of the brick body to define a first direction, each of the first circular portions having a radius of C+(D/2)+A from the center X between opposite ends;

second circular portions respectively on opposite sides of the center X to define a second direction perpendicular to the first direction, each of the second circular portions having a radius of C+(D/2)+B from the center X over an angle Θ=40°±10° therefrom between opposite ends; and third circular portions respectively between the opposite ends of the first and second circular portions, each of the third circular portions having a radius between opposite ends of (D/2)+B respectively from intersections Z of a circular line with a radius C around the center X and a line to the opposite ends of the second circular portions, wherein successive ones of the opposite ends of the first circular portions and the third circular portions are connected along tangent lines for giving a substantially elliptical shape to the sides of the brick body.

* * * * *